US005306597A

United States Patent [19]

Aono

[11] Patent Number: 5,306,597

[45] Date of Patent: Apr. 26, 1994

[54] DYE FIXING ELEMENT

[75] Inventor: Toshiaki Aono, Kanagawa, Japan

[73] Assignee: Fuji Photo Film Co., Ltd., Kanagawa, Japan

[21] Appl. No.: 932,556

[22] Filed: Aug. 20, 1992

[30] Foreign Application Priority Data

Aug. 22, 1991 [JP] Japan ..... 3-233779
Aug. 22, 1991 [JP] Japan ..... 3-233781

[51] Int. Cl.[5] ..... G03C 5/54

[52] U.S. Cl. ..... 430/203; 430/215; 430/259; 430/213; 430/631; 430/638; 430/216

[58] Field of Search ..... 430/203, 215, 259, 631, 430/213, 638, 216

[56] References Cited

U.S. PATENT DOCUMENTS 4,201,586 5/1980 Hori et al. ..... 430/631
4,267,265 5/1981 Sugimoto et al. ..... 430/631
4,665,005 5/1987 Aono et al. ..... 430/215
4,783,392 11/1988 Aono et al. ..... 430/215

*Primary Examiner*—Richard L. Schilling
*Attorney, Agent, or Firm*—Sughrue, Mion, Zinn, Macpeak & Seas

[57] ABSTRACT

A novel dye fixing element is provided comprising a dye fixing layer on which a diffusive dye produced or released by developing a light-sensitive element containing at least a light-sensitive silver halide, a hydrophilic binder and a dye providing compound which produces or releases a diffusive dye in correspondence to or counter correspondence to the exposure in the presence of a base and/or base precursor after or simultaneously with imagewise exposure is transferred and fixed, wherein the outermost layer on the dye fixing layer side or on the opposite side, i.e., back layer side contains at least one compound represented by the following general formula (I) and exhibits a contact angle of 80° or more to a drop of methane iodide $$(RfCH_2O)_n—PO(OM)_m \quad (I)$$

wherein n and m satisfy the equation: $n+m=3$; Rf represents a perfluoroalkyl group; and M represents an alkali metal ion, $NH^{4+}$ or secondary, tertiary or quaternary ammonium ion. The base and/or base precursor is partially or entirely incorporated in the layers constituting the dye fixing element. The contact angle is preferably in the range of 85° or more. The compound represented by the general formula (I) is preferably contained in an amount of 5 to 100% of the total coated amount of said outermost layer as calculated in terms of dry film. Heat development and transfer are effected in the presence of a small amount of water.

8 Claims, 1 Drawing Sheet

DYE FIXING ELEMENT

FIELD OF THE INVENTION

The present invention relates to a dye fixing element for use in a process in which development, particularly heat development is effected to imagewise form a dye which is then transferred thereto to form an image.

BACKGROUND OF THE INVENTION

The silver halide system photography is superior to other photographic processes such as electrophotography and diazo process in sensitivity and gradation adjustment and thus has heretofore been most widely used. In recent years, a technique which can easily and rapidly provide an image has been developed by changing the process for the formation of an image on a light-sensitive material from the wet process with the conventional developer or the like to the dry process by heating or the like.

Many methods for obtaining color images by heat development have been proposed. Methods which comprise the bonding of an oxidation product of a developing agent and a coupler to form a color image have been proposed in U.S. Pat. Nos. 3,531,286, 3,761,270, and 4,021,240, Belgian Patent 802,519, and *Research Disclosure* (September 1975, page 32).

However, these methods are disadvantageous in that an image of reduced silver and a color image are formed on heat developed exposed portions at the same time, causing stain on the color image.

In order to eliminate this disadvantage, many approaches have been proposed, e.g., method which comprises imagewise form or release a mobile (diffusive) dye by heating, and then transferring the mobile dye to a dye fixing element having a mordant with a solvent such as water or a high boiling organic solvent or a hydrophilic heat solvent incorporated in the dye fixing element and method which comprises transferring a thermally diffusive or sublimable dye to a dye receiving element such as support (U.S. Pat. Nos. 4,463,079, 4,474,867, 4,478,927, 4,507,380, 4,500,626, and 4,483,914, and JP-A-58-149046, JP-A 58-149047, JP-A-59-152440, JP-A-59-154445, JP-A-59-165054, JP-A-59-180548, JP-A-59-168439, JP-A-59 174832, JP-A-59-174833, JP-A-59-174834, and JP-A-59-174835 (the term "JP-A" as used herein means an "unexamined published Japanese patent application")).

In general, if dye fixing elements on which an image has been formed by a transfer process such as the above mentioned image formation methods are kept with their surface on the dye fixing layer side laminated opposed to each other, the dye image is retransferred to the counterpart dye fixing layer. In particular, for the purpose of simplifying development process, it is effective to incorporate a base or base precursor in a light-sensitive element or dye fixing element which is then subjected to heat development to form an image. However, the "contact dye transfer" is worsened. Particularly, in a system where heat develoment and transfer are effected in the presence of a small amount of water, a water-soluble base or base precursor is preferably used. In this case, the "contact dye tranfer" is further worsened.

In order to overcome this difficulty, the inventors previously proposed a dye fixing element comprising a nonionic water-soluble polysaccharide (particularly pullulan and dextran) in JP-A-62-47639 ad a dye fixing element having a protective layer mainly comprising an anionic water-soluble polymer as an outermost layer in JP-A-63-103240.

The above mentioned methods exert remarkable effects on the "contact dye transfer". However, if the light-sensitive material is stored under the circumstances of high humidity for prolonged period of time, its effect is not always sufficient. Thus, further improvements have been desired. A polymer dispersion having a glass transition temperature of 25° C. or lower may be effectively incorporated in a dye fixing layer and/or adjacent layers thereto in a dye fixing element free of back layer as a curl balance layer to improve the curling properties. However, this worsens the "contact dye transfer".

In general, means of inhibiting the "contact dye transfer" causes deterioration of transferability also during the image formation, often resulting in an insufficient transfer density.

On the other hand, if a lamination of a light-sensitive material and a dye fixing material to both or either of which a small amount of water has been supplied is subjected to heat development/transfer process, an uneven image (honeycomb density unevenness) which is attributable to partial contact failure may occur depending on the amount of water supplied and heating condition.

A layer comprising a hydrophilic binder is normally provided on the back layer in a dye fixing element as a curl balance layer. If a lamination of such dye fixing elements is stored under the circumstances of high humidity, a base and/or base precursor contained in the surface layer partially migrates to the back layer, causing unevenness in the distribution of the base or base precursor in the surface layer. As a result, when such a dye fixing element laminated with a light-sensitive element is subjected to development and transfer, it causes unevenness in development and transfer. Accordingly, blank areas are generated in the transferred image.

In order to solve this problem, the inventors previously proposed a dye fixing element comprising in the back layer finely divided grains having a size greater than the thickness of the back layer in JP-A-63-274952.

The above mentioned approach exerts remarkable effects in inhibiting the blank areas from generation. However, if the light-sensitive material is stored under the circumstances of high humidity under pressure for prolonged period of time, its effect is not always sufficient. Thus, further improvements have been desired. In particular, if the light-sensitive material is for use in transmission type, the amount of finely divided grains to be added is limited from the standpoint of transparency (haze). Thus, an approach for inhibiting the blank areas from generation without deteriorating trasnparency has been desired.

SUMMARY OF THE INVENTION

It is therefore an object of the present invention to provide a dye fixing element which can provide a sufficient image density without inhibiting transfer during the image formation and doesn't suffer from "contact dye transfer" or "blank areas" even after prolonged storage under the circumstances of high humidity with its dye fixing layer side surface on which an image has been formed laminated opposed to that of another dye fixing element.

It is another object of the present invention is to provide a dye fixing element which is insusceptible to image unevenness under any processing conditions.

These and other objects of the present invention will become more apparent from the following detailed description and examples.

These and other objects of the present invention are accomplished with a dye fixing element comprising a dye fixing layer on which a diffusive dye produced or released by developing a light-sensitive element containing at least a light-sensitive silver halide, a hydrophilic binder and a dye providing compound which produces or releases a diffusive dye in correspondence to or counter correspondence to the exposure in the presence of a base and/or base precursor after or simultaneously with imagewise exposure is transferred and fixed, wherein the outermost layer on the dye fixing layer side or on the opposite side, i.e., back layer side contains at least one compound represented by the following general formula (I) and exhibits a contact angle of 80° or more to a drop of methane iodide $$(RfCH_2O)_n—PO(OM)_m \quad (I)$$

wherein n and m satisfy the equation: n+m=3; Rf represents a perfluoroalkyl group; and M represents an alkali metal ion, $NH^{4+}$ or secondary, tertiary or quaternary ammonium ion.

DETAILED DESCRIPTION OF THE INVENTION

The dye fixing element of the present invention can be used as an image receiving material to be used in a system in which a photographic material comprising a light-sensitive silver halide is developed to form or release a diffusive dye which is then transferred thereto to obtain an image.

This image formation system can be roughly divided into to two systems, i.e., a so-called wet color diffusion transfer process comprising development with a processing solution at temperatures near ordinary temperature and a heat development diffusion transfer process comprising heat development. The dye fixing element of the present invention can be preferably used particularly in the heat development diffusion transfer process. Thus, the dye fixing element of the present invention will be described hereinafter with reference to the heat development diffusion transfer process. This description is common to the wet color diffusion tranfer process except for the factors peculiar to the heat development such as organic silver salt and development process.

In the dye fixing element to be used in the present invention, if an aqueous solution, hydrophilic heat solvent or the like is used as a transfer aid, a hydrophilic dye is normally used. In order to inhibit "contact dye transfer" from a dye fixing element on which an image had been formed with such a dye, the surface properties of the dye fixing element were varied. The effect of the variation of the surface properties of the dye fixing element on the inhibition of "contact dye transfer" was evaluated. As a result, it was found that the wettability of the surface of the dye fixing element is an important factor of the effect. Specifically, it was found that when the surface of a dye fixing element onto which a dye has been developed and transferred exhibits a contact angle of 80° or more, preferably 85° or more to a drop of methane iodide, the "contact dye transfer" can be remarkably inhibited. The contact angle to a drop of methane iodide can be measured by the method described in, for example, *ShinJikken Kagaku Koza,* Vol. 18, "Interface and Colloid", pp. 97-98, edited by The Chemical Society of Japan and published by Maruzen Co., Ltd.

Figure 1:
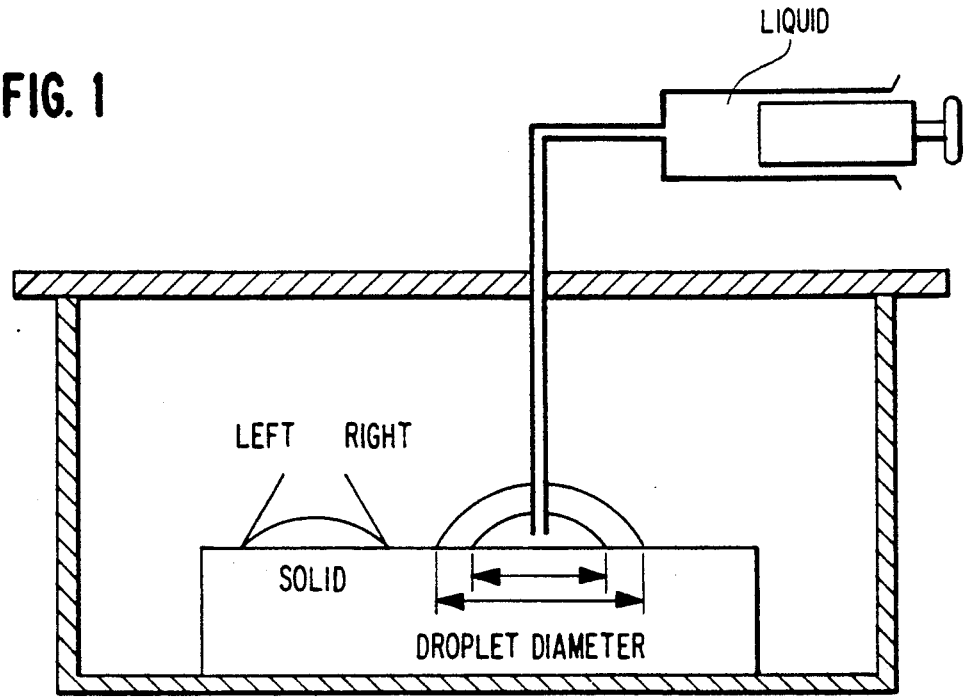
FIG. 1 is a schematic illustration showing the measurement of contact angle by the liquid drop method.
Figure 2:
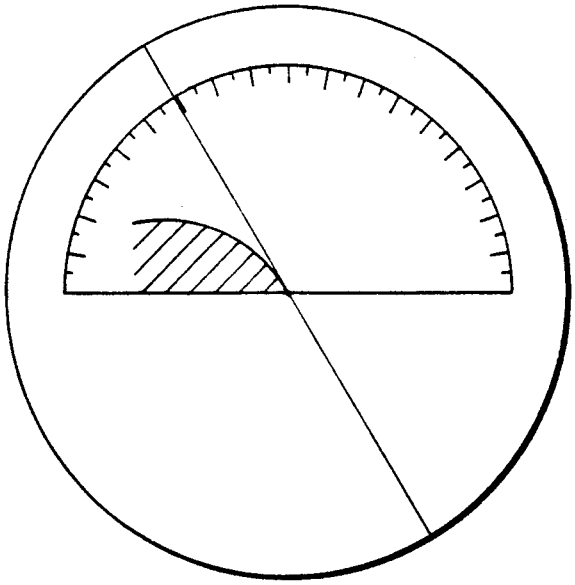
FIG. 2 shows the principle of measuring contact angle with a reading microscope fitted with an angle measuring device.

In particular, in a liquid drop method for measurement of contact angle, a flat plate having its surface finished to specular smoothness is placed in a vessel horizontally as shown in FIG. 1. The vessel is filled with the saturated vapor of the liquid of interest. The liquid is injected from a microsyringe to form its drop on the flat plate. The liquid drop should have such a size that it will contact the plate across a diameter of about 3 mm or less (according to one report, a droplet having a volume of 0.1 $cm^3$ or less will suffice). The contact angle can be generally measured with a reading microscope (magnification of about 20) fitted with an angle measuring device. The principle of this method is shown in FIG. 2. An extremely good image sharpness can be achieved if the lens mount is inclined downward by 1-2° from the horizontal. The liquid is illuminated from the front with light that has been through opal glass or parallel light passed through heat ray absorbing glass.

The precision of measurement is ±1° and it can be improved to ±5° if the operator is a skilled technician. Angle measurements are performed on both right and left sides of the droplet; if a big difference is found, the values of measurement on that droplet should be discarded. Desirably, an additional amount of liquid drop is added or the initially formed droplet is left to stand for a while before angle measurement is conducted to check to see of there if any change in the angle measured. It is also desirable to perform measurements in several different places on the same solid surface to check if the same data are obtained. At least ten values should be taken and subjected to statistical data processing. A frequency value which represents the frequency of the occurrence of the median for 10 measurements can be determined. Representation in terms of median or mean value and 95% confidence limit is also a good method. The liquid drop method is also applicable to the case where a gas bubble or the drop of a light liquid is formed in contact with the flat plate facing down so as to measure the contact angle.

Figure 3:
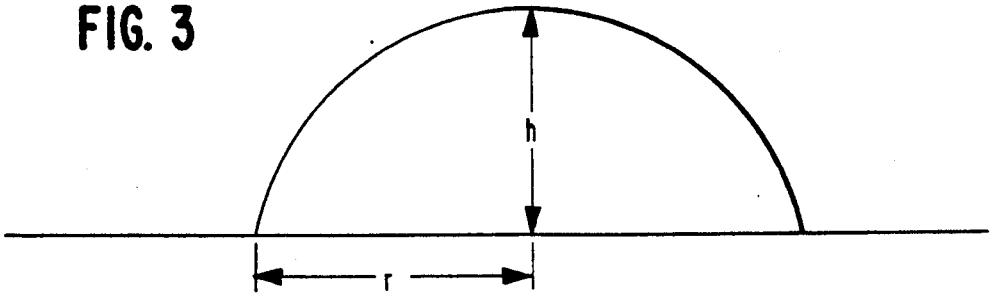
FIG. 3 is an illustration of how the contact angle can be calculated from the shape of the liquid drop.

Instead of reading the contact angle Θ with an angle measuring device, x and h as indicated in FIG. 3 may be measured and the angle Θ is calculated by the following equation:

$$\Theta = 2\tan^{-1}(h/x) \quad (2.44)$$

This method is only applicable to the case where the effect of gravity on the droplet is negligible so that its shape can be regarded as part of a sphere.

In order to inhibit "blank areas" from generation on a dye fixing element, the surface properties of the back surface of the dye fixing element was varied. The effect of the variation of back surface of the surface properties of the dye fixing element on the inhibition of "blank areas" from generation was evaluated. As a result, it was found that the wettability of the surface of of the back surface of the dye fixing element is an important factor of the effect. Specifically, it was found that when the back surface of a dye fixing element onto which a dye has been developed and transferred exhibits a contact angle of 80° or more, preferably 85° or more to a drop of methane iodide, the "blank areas" can be remarkably inhibited from generation.

A particularly effective method of adjusting the contact angle of the surface or back surface of the dye fixing element to 80° or more to a drop of methane iodide is to incorporate a fluorine compound in the outmost layer on the dye fixing layer or back layer side of the dye fixing element. Examples of such a fluorine compound include a compound containing a polar group and from one to three, preferably from one to two perfluorocarbon chains having 5 or more, preferably 8 or more, more preferably 10 or more carbon atoms. As such a fluorine compound there can be preferably used one represented by the following general formula (I):

$$(RfCH_2O)_n—PO(OM)_m \quad (I)$$

wherein n and m satisfy the equation: $n+m=3$: Rf represents a perfluoroalkyl group; and M represents an alkali metal ion, $NH^{4+}$ or secondary, tertiary or quaternary ammonium ion.

Specific examples of the fluorine compound represented by the general formula (I) include $(RfCH_2O)_n—PO\{OH_2N(C_2H_5OH)_2\}$ (in which Rf represents a perfluorocarbon chain having 8 or more carbon atoms), and Asahi Guard AG530 (produced by Asahi Glass Co., Ltd.). Asahi Guard AG530 is a mixture of a perfluoroalkyl phosphate in which one perfluoroalkyl group having 8 to 12 carbon atoms is present and a perfluoroalkyl phosphate in which two perfluoroalkyl groups having 8 to 12 carbon atoms are present in the form of an ethanolamine salt.

Also, the following compounds can be used as the fluorine compound .represented by the general formula (I).

(1) $(C_8F_{17}CH_2O)_2—PO(OH).(H_2NCH_2CH_2OH)$
(2) $(C_{10}F_{21}CH_2O)_2—PO(OH).(H_2NCH_2CH_2OH)$
(3) $(C_{12}F_{25}CH_2O)_2—PO(OH).(H_2NCH_2CH_2OH)$
(4) $C_{16}F_{33}CH_2O—PO(OH)_2.(H_2NCH_2CH_2OH)$
(5) $(C_{12}F_{25}CH_2O)_2—PO(OH).NH_3$
(6) $(C_{12}F_{25}CH_2O)_2—PO(O^-).Na^+$

Two or more of these compounds can be used in combination.

Such a fluorine compound may be incorporated in the outermost layer on the dye fixing layer side or back layer side of the dye fixing element. The content of such a fluorine compound is in the range of 5 to 100%, preferably 25 to 95%, more preferably 40 to 90% of the total coated amount (calculated in terms of dry film) of the outermost layer.

The thickness of the outermost layer containing such a fluorine compound, if it is on the dye fixing layer side, is in the range of 0.05 to 2 μm, preferably 0.1 to 1 μm as calculated in terms of dry thickness. The thickness of the outermost layer containing such a fluorine compound, if it is on the back layer side, is in the range of 0.1 to 10 μm, preferably 0.2 to 2 μm as calculated in terms of dry thickness.

The dye fixing element of the present invention (hereinafter sometimes referred to as "dye fixing material" or "image receiving material") is laminated with a color light-sensitive element (hereinafter sometimes referred to as "light-sensitive material", "heat-developable light-sensitive material" or "light-sensitive element") at least during the transfer of a diffusive dye. In other words, the dye fixing layer of the image receiving material comes in face-to-face contact with the light-sensitive layer of the light-sensitive material at least during the transfer of a diffusive dye.

The image receiving material of the present invention may be in the form to be coated on the same or different support as the light-sensitive material. In respect of the relationship of the light-sensitive material with the image receiving material, the support and the dye reflecting layer, those described in U.S. Pat. No. 4,500,626, column 57 can be applied to the present invention. In the present invention, the image receiving material is preferably coated on a support different from that for the light-sensitive material.

The image receiving material comprises a dye fixing layer on a .support, and optionally an auxiliary layer such as protective layer, peel layer, anticurl layer and back layer. In particular, a protective layer and a back layer are effectively provided. One or more of these layers may comprise a hydrophilic heat solvent, a plasticizer, a discoloration inhibitor, a UV absorbent, a lubricant, a matting agent, an antioxidant, a dispersed vinyl compound for increasing the dimensional stability, etc.

In the present invention, the dye fixing layer comprises a polymer mordant capable of fixing a mobile dye released by development.

Examples of the polymer mordant include polymer containing a tertiary amino group, a polymer containing a nitrogen-containing heterocyclic portion, and a polymer containing a quaternary cationic group thereof. Such a polymer mordant is preferably used in admixture with other hydrophilic polymers (e.g., gelatin).

Polymers containing vinyl monomer units having tertiary amino groups are described in JP-A-60-60643 and JP-A-60-57836. In particular, polymers containing vinyl monomer units having tertiary imidazole groups are preferably used in the light of fastness to light and transfer density. Specific examples of such polymers are described in JP-A-60-118834, JP-A-60-122941, JP-A-62-244043, JP-A-62-244036, and U.S. Pat. Nos. 4,282,305, 4,115,124, and 3,148,061.

Preferred examples of polymers containing vinyl monomer units having quaternary imidazolium salts are described in British Patents 2,056,101, 2,093,041, and 1,594,961, U.S. Pat. Nos. 4,124,386, 4,115,124, 4,273,853, and 4,450,224, and JP-A-48-28225.

Further, preferred examples of polymers containing vinyl monomer units having quaternary ammonium salts are described in U.S. Pat. Nos. 3,709,690, 3,898,088, and 3,958,995, JP-A-60-57836, JP-A-60-60643, JP-A-60-122940, JP-A-60-122942, and JP-A-60-235134.

The molecular weight of the polymer mordant to be used in the present invention is preferably in the range of 1,000 to 1,000,000, particularly 10,000 to 200,000.

Such a polymer mordant is incorporated in the dye fixing layer (hereinafter referred to as "mordant layer") in the image receiving material in combination with a hydrophilic colloid as a binder described later.

The mixing proportion of polymer mordant to hydrophilic colloid and the coated amount of polymer mordant can be easily determined by those skilled in the art depending on the amount of the dye to be mordanted, the kind and composition of polymer mordant, the image formation method to be used, etc. Preferably, the mixing proportion of mordant to hydrophilic colloid is in the range of 20/80 to 80/20 by weight, and the coated amount of mordant is in the range of about 0.2 $g/m^2$ to about 15 $g/m^2$, particularly 0.5 $g/m^2$ to 8 $g/m^2$.

The polymer mordant can be incorporated in the image receiving material in combination with metallic ions to raise the transfer density of dye. These metallic ions can be incorporated in the mordant layer containing a mordant or adjacent layers thereto (which may be close to or remote from the support carrying the mordant layer, etc.). These metallic ions are preferably transparent and stable to heat and light. In other words, these metallic ions are preferably polyvalent ions of transition metals such as $Cu^{2+}$, $Zn^{2+}$, $Ni^{2+}$, $Pt^{2+}$, $Pd^{2+}$ and $Co^{3+}$, particularly $Zn^{2+}$. These metallic ions are normally incorporated in the system in the form of water-soluble compound such as $ZnSO_4$ and $Zn(CH_3CO_2)_2$. The amount of these metallic ions to be added is preferably in the range of about 0.01 $g/m^2$ to about 5 $g/m^2$, more preferably 0.1 $g/m^2$ to 1.5 $g/m^2$.

The layer in which these metallic ions may comprise a hydrophilic polymer as a binder. As such a hydrophilic binder there can be effectively used the hydrophilic colloid previously described with reference to the mordant layer.

The mordant layer comprising such a polymer mordant may comprise various surface active agents for the purpose of improving the coating properties of the material or like purposes.

The image receiving material of the present invention comprises a water-soluble base and/or base precursor from the standpoint of simplification and expedition of processing and preservability.

Examples of bases to be used in the present invention include inorganic bases such as hydroxides, carbonates, bicarbonates, borates, secondary and tertiary phosphates and metaborates of alkali metals and quaternary alkylammoniums; and organic bases such as aliphatic amines, aromatic amines, heterocyclic amines, amidines, cyclic amidines, guanidines and cyclic guanidines, and carbonates, bicarbonates, borates, and secondary and tertiary phosphates thereof.

As the base precursor to be used in the present invention there can be used precursors of the above mentioned organic bases. The base precursor undergoes thermal decomposition or electrolysis to release a basic component. Examples of such a base precursor include a salt of a thermally decomposable organic acid such as trichloroacetic acid, cyanoacetic acid, acetoacetic acid and α-sulfonylacetic acid with the above mentioned organic base, or 2-carboxycarboxamide as described in U.S. Pat. No. 4,088,496. In addition, base precursors as described in British Patent 998,945, U.S. Pat. No. 3,220,846, and JP-A-50-22625 can be used.

As the compound which undergoes electrolysis to produce a base there can be used the following compounds. Typical examples of methods using electrolytic oxidation include the electrolysis of various aliphatic salts. In accordance with this reaction, carbonates of alkali metals or organic bases such as guanidines and amidines can be extremely efficiently obtained. Examples of methods using electrolytic reduction include the production of amines by reduction of nitro and nitroso compounds, the production of amines by reduction of nitriles, and the production of p-aminophenols, p-phenylenediamines and hydrazines by reduction of nitro compounds, azo compounds, azoxy compounds, etc. p-Aminophenols, p-phenylenediamines and hydrazines may be used not only as bases but also directly as color image-forming substances. It goes without saying that the electrolysis of water in the presence of various inorganic salts to produce an alkaline component can be utilized.

Further, as mentioned in U.S. Pat. No. 4,740,445, the reaction of a compound (e.g., guanidium picolate) capable of complexing with metallic ions constituting a difficultly soluble metal salt compound (e.g., zinc oxide, basic zinc carbonate, calcium carbonate) in the presence of water as a medium with the difficultly soluble metal salt compound can be utilized to produce a water-soluble base. In accordance with this method, a light-sensitive material comprising a dispersion of the difficultly soluble metal salt compound incorporated therein and an image receiving material comprising as a base precursor a water-soluble compound capable of complexing with the metallic ions incorporated therein can be subjected to heat treatment in close contact with each other in the presence of water to produce a base. Thus, this method is particularly effective in the light of storability.

These bases and/or base precursors may be used singly or in combination.

The amount of these bases and/or base precursors to be used is normally in the range of $5\times10^{-4}$ to $5\times10^{-1}$ mole/$m^2$, preferably $2.5\times10^{-3}$ to $2.5\times10^{-2}$ mole/$m^2$.

The polymer dispersion to be incorporated in the dye fixing element of the present invention as an anticurling agent is preferably such that the polymer constituting the dispersion exhibits a glass transition temperature of 25° C. or lower. Even if the glass transition temperature of the polymer is higher than 25° C., the polymer may be used in combination with an oily plasticizer to substantially exhibit a glass transition temperature of 25° C. or lower. In order to incorporate the plasticizer in the polymer dispersion, the plasticizer may be present in the system during the synthesis. In general, the polymer dispersion may be stirred for a predetermined period of time in admixture with the plasticizer emulsion.

Examples of the polymer dispersion to be used in the present invention include latexes synthesized by the emulsion homopolymerization or emulsion copolymerization of vinyl acetate compounds, ethylene-vinyl acetate compounds, acrylic compounds, vinylidene chloride compounds, vinyl chloride compounds, butadiene compounds or butadiene derivatives, and polymer dispersions obtained by the emulsion dispersion of a solution of the above mentioned polymers, polyesters and polyrethanes or the like in an organic solvent. In particular, vinyl acetate, ethylene-vinyl acetate, acrylic and styrene-butadiene dispersions are preferably used from the standpoint of fastness to light, thermal stability, diffusion stability of coating solution, anticurling effect, inhibition of deposition of salts, etc.

Specific examples of polymer latexes to be incorporated in the dye fixing element of the present invention as curling property improvers will be given below, but the present invention should not be construed as being limited thereto.

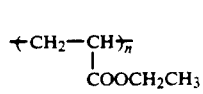

P-1

-continued

Tg = −21° C.

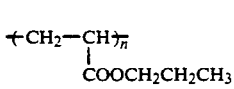

Tg = −36° C.

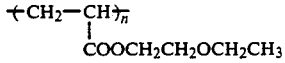

Tg = −47° C.

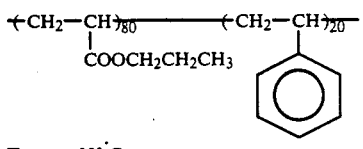

Tg = −20° C.

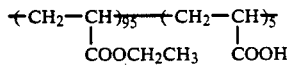

Tg = −11° C.

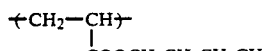

Tg = −53° C.

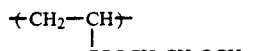

Tg = −45° C.

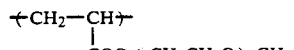

Tg = −36° C.

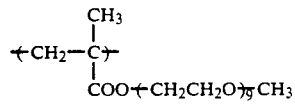

Tg = −18° C.

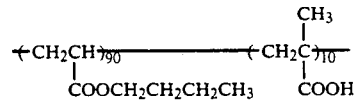

Tg = −26° C.

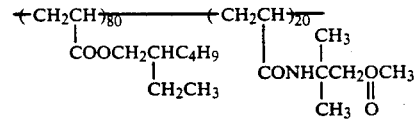

Tg = −17° C.

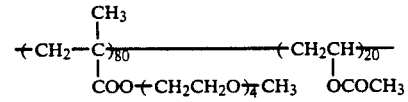

Tg = −4° C.

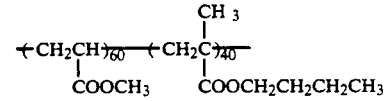

Tg = 15° C.

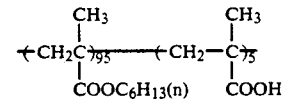

Tg = 6° C.

-continued

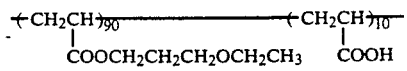

Tg = −2° C.

(Copolymerization proportion is represented in mole %)

Further, various commercially available latexes and emulsions can be used. Examples of such latexes and emulsions include Nipol LX811, 814, 820, 821, 822, 823, 825, 826, 842, 851, 852, 854, 855, 857, 860, 874, 110, 112, 119, 139, 206, 209, 600, 415A, 426, 430, 432A, 433, 435, 436, 438C, 472, 473, 479, 511, 513, 517, 518, 531, 407F (produced by Nippon Zeon Co., Ltd.), Polysol (various latexes or emulsions of vinyl acetate, vinyl acetate-acryl, ester acrylate, vinyl acetate-VeoVa, styrene-acryl and ethylene-vinyl acetate commercially available from Showa High Polymer Co., Ltd.), and VONDIC 1040, 1050, 1310F, 1320NS, 1340, 1510, 1610NS, 1612NS, 1640, 1660, 1670 (N), 1930N, 1980 (produced by Dainippon Ink And Chemicals, Inc.).

The amount of the polymer latex to be added is defined as the proportion of the total volume of polymer in the latex incorporated in the layer to the total volume of the hydrophilic binder incorporated in the layer and is preferably in the range of 5 to 300 vol %, more preferably 10 to 200 vol %. If this value falls below 5 vol %, it gives a reduced effect of inhibiting crack. On the contrary, if this value exceeds 300 vol %, it gives a reduced film strength, showing a tendency for the glossiness to drop. As calculated in terms of coated amount, the amount of the polymer latex to be added is preferably in the range Of 0.5 g/m$^2$ to 10 g/m$^2$, more preferably 1 g/m$^2$ to 5 g/m$^2$.

The polymer latex to be used in the present invention exerts remarked effects if a polymer mordant having a high glass transition temperature, particularly 25° C. or higher is used.

The light-sensitive element to be used in combination with the dye fixing element of the present invention may be subjected to wet processing in the vicinity of ordinary temperature or heat developed. The latter type of a light-sensitive element is preferred because it exerts more remarkable effects of the present invention when used in combination with the dye fixing element of the present invention. The light-sensitive element essentially comprises a light-sensitive silver halide, a dye providing compound (as mentioned below, a reducing agent may serve as a dye providing compound as well), and a binder provided on a support, and optionally an organic metal salt oxidizer. These components are often incorporated in the same layer but may be separately incorporated in separate layers if they are in a reactive form. For example, a colored dye providing compound may be present in a layer under the silver halide emulsion to inhibit the drop in sensitivity. The reducing agent is preferably incorporated in the light-sensitive element but may be externally supplied, e.g., by diffusion from the dye fixing element as described later.

In order to obtain a wide range of colors in the chromaticity diagram from the subtractive primaries, i.e., yellow, magenta and cyan, at least three silver halide emulsion layers having light-sensitivity in different spectral ranges are used in combination. For example, a combination of a blue-sensitive layer, a green-sensitive layer and a red-sensitive layer or a combination of a green-sensitive layer, a red-sensitive layer and an infra-red-sensitive layer may be used. These light-sensitive layers may be arranged in various orders known in the field of the ordinary type color light-sensitive materials. These light-sensitive layers may each be divided into two or more layers as necessary.

The heat developable light-sensitive material may be provided with various auxiliary layers such as protective layer, subbing layer, interlayer, yellow filter layer, antihalation layer and back layer.

The silver halide to be used in the present invention may be any of silver chloride, silver bromide, silver bromoiodide, silver bromochloride, silver chloroiodide and silver bromochloroiodide.

The silver halide emulsion to be used in the present invention may be a surface latent image type emulsion or an internal latent image type emulsion. The internal latent image type emulsion may be used as a direct reversal emulsion when combined with a nucleating agent or light fogging. The silver halide emulsion to be used in the present invention may be a so-called core-shell emulsion differing from core to shell in phase. The silver halide emulsion may be monodispersed or polydispersed. Alternatively, monodisperse silver halide emulsions may be used in admixture. The grain size of silver halide grains is preferably in the range of 0.1 to 2 μm, particularly 0.2 to 1.5 μm. The crystal habit of silver halide grains may be any of cubic form, octahedral form, tetradecahedal form, tabular form having a high aspect ratio, and other crystal forms.

Specifically, any of silver halide emulsions disclosed in U.S. Pat. Nos. 4,500,626 (50th column) and 4,628,021, *Research Disclosure* (hereinafter referred to as "RD") No. 17029 (1978), and JP-A-62-253159 may be used.

The silver halide emulsion may be used unripened but is normally subjected to chemical sensitization before use. For example, an emulsion for the ordinary type light-sensitive material may be subjected to known sulfur sensitization, reduction sensitization, noble metal sensitization and selenium sensitization singly or in combination. These chemical sensitization processes can be effected in the presence of a nitrogen-containing heterocyclic compound as described in JP-A-62-253159.

The coated amount of the light-sensitive silver halide emulsion to be used in the present invention is in the range of 1 mg/m$^2$ to 10 g/m$^2$ as calculated in terms of silver.

The silver halide emulsion to be used in the present invention may be subjected to spectral sensitization with a methine dye or the like. Examples of dyes to be used in the spectral sensitization include cyanine dye, merocyanine dye, complex cyanine dye, complex merocyanine dye, holopolar cyanine dye, hemicyanine dye, styryl dye and hemioxonol dye.

Specifically, sensitizing dyes as disclosed in U.S. Pat. No. 4,617,257, JP-A-59-180550, JP-A-60-140335, and RD17029 (1978), pp. 12 - 13, can be used.

These sensitizing dyes can be used singly or in combination. A combination of these sensitizing dyes is often used particularly for the purpose of supersensitization.

Besides these sensitizing dyes, a dye which doesn't exert a spectral sensitizing effect itself or a compound which doesn't substantially absorb visible light but exerts a supersensitizing effect may be incorporated in the emulsion (as disclosed in U.S. Pat. No. 3,615,641 and JP-A-63-23145).

The time at which these sensitizing dyes are incorporated in the emulsion may be during or before or after the chemical ripening or may be before or after the nucleation of silver halide grains as disclosed in U.S. Pat. Nos. 4,183,756 and 4,225,666. The amount of these sensitizing dyes to be added is normally in the range of about $10^{-8}$ mole to $10^{-2}$ mole per mole of silver halide.

If the dye fixing element of the present invention is used in a heat-developable system, the light-sensitive element may comprise an organic metal salt as an oxidizer in combination with the light-sensitive silver halide emulsion. Particularly preferred among these organic metal salts are organic silver salts.

Examples of organic compounds which can be used to form such an organic silver salt oxidizer include benzotriazoles and aliphatic acids as disclosed in U.S. Pat. No. 4,500,626, 52nd column to 53rd column, and other compounds. Other useful examples of organic compounds include silver salts of carboxylic acids containing an alkynyl group such as silver phenylpropiolate as described in JP-A-60-113235, and silver acetylene as described in JP-A-61-249044. Two or more of these organic silver salts may be used in combination.

The above mentioned organic silver salt can be used in an amount of 0.01 to 10 mole, preferably 0.01 to 1 mole per mole of light-sensitive silver halide. The sum of the coated amount of light-sensitive silver halide and organic silver salt is preferably in the range of 50 mg/m$^2$ to 10 g/m$^2$ as calculated in terms of silver.

In the present invention, various fog inhibitors or photographic stabilizers can be used. Examples of such fog inhibitors or photographic stabilizers include azoles and azaindenes as disclosed in RD17643 (1978), pp. 24–25, carboxylic acids and phosphoric acids containing nitrogen as disclosed in JP-A-59-168442, mercapto compounds and metallic salts thereof as disclosed in JP-A-59-111636, and acetylene compounds as disclosed in JP-A-62-87957.

As the reducing agent to be used in the present invention there can be used ones known in the field of light-sensitive material. Reducing dye providing compounds as described later can also be used (in this case, other reducing agents can be used in combination therewith). Further, a reducer precursor which exhibits no reducing effect itself but exerts a reducing effect when acted by a nucleophilic reagent or heat during development can be used.

Examples of reducing agents which can be used in the present invention include reducing agents and reducer precursors as disclosed in U.S. Pat. Nos. 4,500,626 (49th column–50th column), 4,483,914 (30th column - 31st column), 4,330,617, and 4,590,152, JP-A-60-140335, pp. 17 - 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP A-60-128439, JP-A-60-198540, JP-A-60-181742, JP-A-61-259253, JP-A-62-244044, JP-A-62-131253, JP-A-62-131254, JP-A-62-131255, JP-A-62-131256, and European Patent 220,746A2, pp. 78–96.

A combination of various reducing agents as disclosed in U.S. Pat. No. 3,039,869 can be used.

In the case where a nondiffusible reducing agent is used, an electron transfer agent and/or electron transfer agent precursor can be optionally used in combination therewith to accelerate the migration of electrons between the nondiffusible reducing agent and the developable silver halide.

Such an electron transfer agent or precursor thereof can be selected from the above mentioned reducing agents or precursors thereof. The electron transfer agent or precursor thereof preferably exhibits a greater mobility than the nondiffusible reducing agent (electron donor). Particularly useful electron transfer agents are 1-phenyl-3-pyrazolidones or aminophenols.

As the nondiffusible reducing agent (electron donor) to be used in combination with the electron transfer agent there can be selected any compounds which substantially don't migrate in the layers constituting light-sensitive material from the above mentioned reducing agents. Preferred examples of such nondiffusible reducing agents include hydroquinones, sulfonamidophenols, sulfonamidonaphtholes, compounds described as electron donors in JP-A-53-110827, and nondiffusible reucing dye providing compounds as described later.

In the present invention, a compound which produces or releases a mobile dye in correspondence or counter correspondence to exposure, i.e., dye providing compound is used.

Examples of dye providing compounds which can be used in the present invention include compounds (couplers) which undergo oxidative coupling reaction to form a dye. These couplers may be two-equivalent or four-equivalent. Further, two-equivalent couplers containing a nondiffusible group as a split-off group which undergo oxidative coupling reaction to form a diffusible dye can be previously used. These nondiffusible groups may form a polymer chain. Specific examples of color developing agents and couplers are further described in T. H. James, *The Theory of the Photographic Process,* 4th ed., pp. 291 - 334 and pp. 354 - 361, JP-A-58-123533, JP-A-58-149046, JP-A-58-149047, JP-A-59-111148, JP-A-59-124399, JP-A-59-174835, JP-A-59-231539, JP-A-59 231540, JP-A-60-2950, JP-A-60-2951, JP-A-60-14242, JP-A-60-23474, and JP-A-60-66249.

Another example of dye providing compound is a compound which serves to imagewise release or diffuse a diffusive dye. This type of a compound can be represented by the following general formula [LI]:

$$(\text{Dye}—\text{Y})_n—\text{Z} \qquad [\text{LI}]$$

wherein Dye represents a dye group, or a dye group or dye precursor group which has been temporarily shifted to short wavelength; Y represents a mere bond or linking group; Z represents a group which makes difference in the diffusibility of the compound represented by $(\text{Dye-Y})_n$—Z or releases Dye to make difference in diffusibility from $(\text{Dye}—\text{Y})_n$—Z in correspondence or counter correspondence to a light-sensitive silver salt having an imagewise latent image; and n represents an integer 1 or 2, with the proviso that when n is 2, the two (Dye-Y)'s may be the same or different.

Specific examples of the dye providing compound represented by the general formula [LI] include the following compounds (1) to (5). The compounds (1) to (3) form a diffusive dye image (positive dye image) in counter correspondence to the development of silver halide. The compounds (4) and (5) form a diffusive dye image (negative dye image) in correspondence to the development of silver halide.

(1) Dye developing agents in which a hydroquinone developing agent and a dye component are connected to each other as disclosed in U.S. Pat. Nos. 3,134,764, 3,362,819, 3,597,200, 3,544,545, and 3,482,972. These dye developing agents are diffusible under alkaline conditions but react with silver halide to become nondiffusible.

(2) As described in U.S. Pat. No. 4,503,137, nondiffusible compounds can be used which release a diffusible dye under alkaline conditions but react with silver halide to lose its capability. Examples of such nondiffusible compounds include compounds which undergo intramolecular nucleophilic displacement reaction to release a diffusible dye as disclosed in U.S. Pat. No. 3,980,479, and compounds which undergo intramolecular rearrangement reaction of isooxazolone rings to release a diffusible dye as disclosed in U.S. Pat. No. 4,199,354.

(3) As disclosed in U.S. Pat. Nos. 4,559,290, and 4,783,396, European Patent 220,746A2, and Kokai Giho 87-6199, nondiffusible compounds can be used which react with a reducing agent left unoxidized upon development to release a diffusible dye.

Examples of such nondiffusible compounds include compounds which undergo intramolecular nucleophilic displacement reaction after reduction to release a diffusible dye as described in U.S. Pat. Nos. 4,139,389 and 4,139,379, JP-A-59-185333, and JP-A-57-84453, compounds which undergo intramolecular electron migration reaction after reduction to release a diffusible dye as described in U.S. Pat. No. 4,232,107, JP-A 59-101649, JP-A-61-88257, and RD24025 (1984), compounds which undergo cleavage of single bond after reduction to release a diffusible dye as described in German Patent 3,008,588A, JP-A-56-142530, and U.S. Pat. Nos. 4,343,893 and 4,619,884, nitro compounds which release a diffusible dye after receiving electrons as described in U.S. Pat. No. 4,450,223, and compounds which release a diffusible dye after receiving electrons as described in U.S. Pat. No. 4,609,610.

Preferred examples of such nondiffusible compounds include compounds containing N-X bond (in which X represents oxygen, sulfur or nitrogen atom) and an electrophilic group per molecule as disclosed in European Patent 220,746A2, Kokai Giho 87-6199, U.S. Pat. No. 4,783,396, JP-A-63-201653, and JP-A-63-201654, compounds containing S02-X bond (in which X is as defined above) and an electrophilic group per molecule as disclosed in JP-A-1-26842, compounds containing PO-X bond (in which X is as defined above) and an electrophilic group per molecule as disclosed in JP-A-63-271344, and compounds containing C-X′ bond (in which X′ has the same meaning as X or represents $—SO_2—$) and an electrophilic group per molecule as disclosed in JP-A-63-271341. Compounds which undergo cleavage of single bond after reduction by x bond conjugated with electron accepting group to release a diffusible dye a disclosed in JP-A-1-161237 and JP-A-1-161342 can also be used.

Particularly preferred among these compounds are compounds containing N-X bond and an electrophilic group per molecule. Specific examples of these compounds include Compounds (1) to (3), (7) to (10), (12), (13), (15), (23) to (26), (31), (32), (35), (36), (40), (41), 44), (53) to (59), (64), and (70) as disclosed in European Patent 220,746A2 or U.S. Pat. No. 4,783,396, and Compounds (11) to (23) as disclosed in Kokai Giho 87-6199.

(4) Coupler compounds containing a diffusible dye as a split-off group which undergo reaction with an oxidation product of a reducing agent to release a diffusible dye (DDR couplers). Specific examples of such DDR couplers are described in British Patent 1,330,524, JP-B-48-39165, and U.S. Pat. Nos. 3,443,940, 4,474,867, and 4,483,914 (the term "JP-B" as used herein means an "examined Japanese patent publication").

(5) Compounds which are capable of reducing silver halides or organic silver salts and release a diffusible dye when reducing the silver halides or organic silver salts (DRR compounds). These compounds don't require the use of other reducing agents, eliminating the stain on the image with an oxidative decomposition product of reducing agents. Typical examples of such DRR compounds are described in U.S. Pat. Nos. 3,928,312, 4,053,312, 4,055,428, 4,336,322, 3,725,062, 3,728,113, 3,443,939, and 4,500,626, JP-A-59-65839, JP-A-59-69839, JP-A-53-3819, JP-A-51-104343, JP-A-58-116537, JP-A-57-179840, and RD17465. Specific examples of these DRR compounds include compounds as disclosed in U.S. Pat. No. 4,500,626, 22nd column to 44th column. Particularly preferred among these compounds are Compounds (1) to (3), (10) to (13), (16) to (19), (28) to (30), (33) to (35), (38) to (40), and (42) to (64). Further, compounds as described in U.S. Pat. No. 4,639,408, 37th column to 39th column, are useful.

As dye providing compounds other than the above mentioned couplers and dye providing compounds represented by the general formula [LI] there can be used dye silver compounds in which an organic silver salt and a dye are connected to each other (*Research Disclosure,* May 1978, pp. 54–58), azo dyes for use in heat development silver dye bleaching process (U.S. Pat. No. 4,235,957, *Research Disclosure,* April 1976, pp. 30–32), and leuco dyes (U.S. Pat. Nos. 3,985,565 and 4,022,617).

The incorporation of a hydrophobic additive such as dye providing compound and nondiffusible reducing agent in the layers constituting the light-sensitive material can be accomplished by any known method. In this case, a high boiling organic solvent as disclosed in JP-A-59-83154, JP-A-59-178451, JP-A-59-178452, JP-A-59-178453, JP-A-59-178454, JP-A-59-178455, and JP-A-59-178457 can be used in combination with an organic solvent having a boiling point as low as 50° C. to 160° C. as necessary.

The amount of the high boiling organic solvent to be used is in the range of 10 g or less, preferably 5 g or less per g of dye providing compound used or 1 cc or less, more preferably 0.5 cc or less, particularly 0.3 cc or less per g of binder used.

Alternatively, a dispersion process with a polymer as described in JP-B-51-39853 and JP-A-51-59943 can be used.

A compound substantially insoluble in water can be finely dispersed in the binder in addition to the above mentioned methods.

When a hydrophobic compound is dispersed in a hydrophilic colloid, various surface active agents can be used. For example, compounds disclosed as surface active agents in JP-A-59-157636, pp. 37–38, can be used.

In the present invention, a compound which not only activates development but also stabilizes an image may be incorporated in the light-sensitive material. Specific examples of such compounds which can be preferably used are described in U.S. Pat. No. 4,500,626, 51st column to 52nd column.

As the binder to be incorporated in the layers constituting the light-sensitive material and the dye fixing material there may be preferably used a hydrophilic binder. Examples of such a hydrophilic binder include those described in JP-A-62-253159, pp. 26–28. In particular, a transparent or semitransparent hydrophilic binder is preferred. Examples of such a transparent or semitransparent hydrophilic binder include natural compounds such as protein, e.g., gelatin and gelatin derivative and polysaccharides, e.g., starch, gum arabic, dextran and pullulan, polyvinyl alcohol, polyvinylpyrrolidone, acrylamide polymer, and other synthetic high molecular compounds. Further, a high water absorption polymer as disclosed in JP-A-62-245260, i.e., homopolymer of vinyl monomer containing —COOM or —$SO_3M$ (in which M represents a hydrogen atom or alkali metal) or a copolymer of vinyl monomers or with other vinyl monomers (e.g., sodium methacrylate, ammonium methacrylate, Sumikagel L-5H produced by Sumitomo Chemical Company, Limited) can be used. Two or more of these binders may be used in combination.

In the case where a system in which heat development is effected with a slight amount of water being supplied is employed, the above mentioned high water absorption polymer can be used to expedite the absorption of water. Further, such a high water absorption polymer can be incorporated in the dye fixing layer or its protective layer to prevent a dye transferred from being retransferred from the dye fixing material to other materials.

In the present invention, the coated amount of binder is preferably in the range of 20 g or less, more preferably 10 g or less, particularly 7 g or less per $m^2$ of the material.

Examples of film hardeners to be incorporated in the layers constituting the light-sensitive material or dye fixing material include those described in U.S. Pat. No. 4,678,739, 1st column, JP-A-59-116655, JP-A-62-245261, and JP-A-61-18942. Specific examples of such film hardeners include aldehyde film hardeners (e.g., formaldehyde), aziridine film hardeners, epoxy film hardeners, vinylsulfone film hardeners (e.g., N,N'-ethylene-bis(vinylsulfonylacetamido)ethane), N-methylol film hardeners (e.g., dimethylolurea), and high molecular film hardeners (e.g., compounds as described in JP-A-62-234157).

Particularly preferred among these film hardeners are epoxy film hardeners from the standpoint of coating properties (e.g., age stability of coating solution in the form of solution and reactivity of coating solution with adjacent layers at coating), film quality (e.g., age stability and curing properties of fresh specimen) and photographic properties (e.g., transfer density). Specific examples of such epoxy film hardeners include film hardeners as disclosed in JP-A-62-91942.

In the present invention, the light-sensitive material and/or dye fixing material can comprise an image formation accelerator. Such an image formation accelerator serves to accelerate the redox reaction of a silver salt oxidizer and a reducing agent, accelerate reaction such as production or decomposition of a dye from a dye providing substance and release of a diffusible dye from a dye providing substance o accelerate the migration of a dye from the light-sensitive material layer to the dye fixing layer. From the standpoint of physicochemical function, the image formation accelerator can be classified as base or base precursor, nucleophilic compound, high boiling organic solvent (oil), heat solvent, surface active agent, compound interacting with silver or silver ion, etc. However, these substance groups normally have composite functions and exert some of these accelerating effects in combination. These image formation accelerators are further described in U.S. Pat. No. 4,678,739, 38th column–40th column.

In the present invention, the light-sensitive material and/or dye fixing material may comprise various development stop agents for the purpose of obtaining an invariably constant image quality against the fluctuation of processing temperatue and time during development.

The development stop agent is a compound which rapidly neutralizes or reacts with a base after a proper development to reduce the base concentration in the film to stop development or a compound which interacts with silver or a silver salt after a proper development to inhibit develoment. Specific examples of such a development stop agent include an acid precursor which releases an acid under heating, an electrophilic compound which undergoes displacement reaction with a base present therewith under heating, a nitrogen-containing heterocyclic compound, and a mercapto compound and precursor thereof. These compounds are further described in JP A-62-253159, pp. 31–32.

The layers (including back layer) constituting the light-sensitive material or dye fixing material may comprise various polymer latexes for the purpose of improving the film properties, e.g., stabilizing dimension and inhibiting curling, adhesion, film crack and pressure sensitization or desensitization. Specifically, any of polymer latexes as disclosed in JP-A-62-245258, JP-A-62-136648, and JP-A-62-110066 can be used. In particular, a polymer latex having a glass transition point as low as 40° C. or lower can be incorporated in the mordant layer to inhibit cracking of the mordant layer. Further, a polymer latex having a high glass transition point can be incorporated in the back layer to provide an anticurling effect.

The layers constituting the light-sensitive material and dye fixing material can comprise a plasticizer, a lubricant or a high boiling organic solvent as an agent for improving the peelability between the light-sensitive material and the dye fixing material. Specific examples of these agents include those described in JP-A-62-253159, page 25 and JP-A-62 245253.

Further, for the above mentioned purposes, various silicone oils (ranging from dimethyl silicone oil to modified silicone oils obtained by incorporating various organic groups in dimethyl siloxane) can be used. Useful examples of such silicone oils are various modified silicone oils described in *Modified Silicone Oil* (technical report published by Shin-Etsu Silicone Co., Ltd.), page 6–18B, particularly carboxy-modified silicone (trade name: X-22-3710).

Further, silicone oils as disclosed in JP-A-62-215953 and JP-A-63-46449 can also be effectively used.

The light sensitive material or dye fixing material may comprise a discoloration inhibitor. Examples of such a discoloration inhibitor include antioxidant, ultraviolet absorbent, and various metal complexes.

Examples of such an antioxidant include chroman compounds, coumaran compounds, phenol compounds (e.g., hindered phenols), hydroquinone derivative, hindered amine derivative, and spiroindane compounds. Further, compounds as described in JP-A-61-159644 can also be effectively used as antioxidants.

Examples of ultraviolet absorbents to be used as discoloration inhibitors include benzotriazole compounds as disclosed in U.S. Pat. No. 3,533,794, 4-thiazolidone compounds as disclosed in U.S. Pat. No. 3,352,681, benzophenone compounds as disclosed in JP-A-46-2784, and compounds as disclosed in JP-A-54-48535, JP-A-62-136641, and JP-A-61-88256. Further, ultraviolet-absorbing polymers as disclosed in JP-A-62-260152 can also be effectively used as ultraviolet absorbents.

Examples of metal complexes to be used as discoloration inhibitors include compounds as disclosed in U.S. Pat. Nos. 4,241,155, 4,245,018, 3rd column–36th column, and 4,254,195, 3rd column–8th column, JP-A-62-174741, JP-A-61-88256, pp. 27–29, JP-A-63-199248, JP-A-1-75568, and JP-A-1-74272.

Useful examples of such discoloration inhibitors are disclosed in JP-A-62-215272, pp. 125–137.

The discoloration inhibitor for inhibiting the transfer of a dye which has been transferred to the dye fixing material may be previously incorporated in the dye fixing material or supplied into the dye fixing material externally, e.g., from the light-sensitive material.

The above mentioned antioxidants, ultraviolet absorbents and metal complexes may be used in combination.

The light-sensitive material or dye fixing material may comprise a fluorescent brightening agent. In particular, such a fluorescent brightening agent is preferably incorporated in the dye fixing material or supplied into the dye fixing material externally, e.g., from the light-sensitive material. Examples of such a fluorescent brightening agent include compounds as disclosed in K. Veenkataraman, *The Chemistry of Synthetic Dyes,* vol. V, Chapter 8, and JP-A-61-143752. Specific examples of such a fluorescent brightening agent include stilbene compounds, coumarin compounds, biphenyl compounds, benzoxazolyl compounds, naphthalimide compounds, pyrazoline compounds, and carbostyryl compounds.

Such a fluorescent brightening agent can be used in combination with a discoloration inhibitor.

The layers constituting the light-sensitive material or dye fixing material can comprise various surface active agents for the purpose of aiding coating, improving peelability and slip properties, inhibiting electrification, accelerating development or like purposes. Specific examples of such surface active agents are described in JP-A-62-173463 and JP-A-62-183457.

The light-sensitive material or dye fixing material can comprise a matting agent. Examples of such a matting agent include silicon dioxide, polyolefin and polymethacrylate as described in JP-A-61-88256, page 29, and benzoguanamine resin beads, polycarbonate resin beads and AS resin beads as described in JP-A-63-274944 and JP-A-63-274952.

In addition, the layers constituting the light-sensitive material and dye fixing material may comprise a heat solvent, an anti-foaming agent, a bacteriacide, a mildewproofing agent, a colloidal silica, etc. These additives are further described in JP-A-61-88256, pp. 26–32.

In the present invention, as the support for the light-sensitive material and dye fixing material there can be used any support material which can withstand the processing temperature. In general, paper and synthetic high molecular compounds (film) are used. Examples of such support materials include polyethylene terephthalate, polycarbonate, polyvinyl chloride, polystyrene, polypropylene, polyimide, celluloses (e.g., triacetyl cellulose), support materials obtained by incorporating a pigment such as titanium oxide in these films, paper obtained by film process synthesis of polypropylene, mixed paper made from a synthetic resin pulp such as polyethylene and a natural pulp, Yankee paper, baryta paper, coated paper (particularly cast coat paper), metal, cloth, and glass.

These support materials can be used directly or in the form of a laminate with a synthetic high molecular compound such as polyethylene on one or both sides thereof.

Besides these support materials, support materials as disclosed in JP-A-62-253159, pp. 29–31, can be used.

Onto the surface of these support materials may be coated a hydrophilic binder, an oxide of semiconducting metal such as alumina sol and tin oxide, carbon black, and other antistatic agents.

Examples of methods for imagewise exposing the light-sensitive material to record an image thereon include a method which comprises directly photographing scenes or persons using a camera or the like, a method which comprises exposure through a reversal film or negative film using a printer or enlarger, a method which comprises scanning exposure to an orginal image through a slit using an exposing apparatus in a copying machine, a method which comprises exposure to light emitted by a light emitting diode or various lasers excited by an electrical signal representative of image data, and a method which comprises exposure directly or through an optical system to image data outputted to an image display apparatus such as CRT, liquid crystal display, electroluminescence display and plasma display.

Examples of light sources to be used in recording an image on the light-sensitive material include natural light, tungsten lamp, light emitting diode, laser, CRT, and other light sources as described in U.S. Pat. No. 4,500,626, 56th column.

Further, a wavelength conversion element in which a nonlinear optical material is combined with a coherent light source such as laser can be used to effect imagewise exposure. The nonlinear optical material is a material capable of developing nonlinearity between polarization and electric field created when a strong photoelectric field such as laser is given. Inorganic compounds such as lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds as described in JP-A-61-53462 and JP-A-62-210432. As wavelength conversion elements there have been known single crystal light guide type wavelength conversion element, fiber type wavelength conversion element, etc. Any of these types of wavelength conversion elements can be effectively used.

Examples of the image data which can be used include image signal obtained from video camera, electronic still camera, etc., television signal stipulated by Nippon Television Signal Code (NTSC), image signal obtained by dividing an orginal image into many pixels by a scanner, and image signal produced by computers such as CG and CAD.

The heating temperature at the heat development process depends on the film pH to be adjusted with a base or base precursor. The heat development can be effected at a heating temperature of about 25° C. to about 250° C., preferably 50° C. to 200° C., particularly about 70° C. to about 180° C. The diffusion transfer of a dye may be effected at the same with or after the heat development process. In the latter case, the transfer of a dye can be effected at a heating temperature ranging from the heat development temperature to room temperature, particularly preferably 50° C. to a temperature about 10° C. lower than the heat development temperature.

The migration of a dye can be effected by heat alone. In order to accelerate the migration of a dye, a solvent may be used. As described in detail in JP-A-59-218443 and JP-A-61-238056, the system is preferably heated in the presence of a small amount of a solvent (particularly water) to simultaneously or continuously effect development and transfer. In this process, the heating temperature is preferably from 50° C. to a temperature lower than the boiling point of the solvent, e.g., 100° C. or lower if the solvent is water.

The amount of water to be used in this process is at least 0.1 time the total weight of the coated film of the light-sensitive element and the dye fixing element, preferably from 0.1 time the total weight of the coated film to the weight of water corresponding to the maximum swellable volume of the coated film, more preferably from 0.1 time the total weight of the coated film to the weight of water corresponding to the maximum swellable volume of the coated film, with the total weight of the coated film being subtracted therefrom.

Under wet conditions, the film is unstable and may cause local stain. In order to avoid this problem, the amount of water to be used is preferably not more than the weight of water corresponding to the maximum swellable volume of the coated film of the light-sensitive element and the dye fixing element. Specifically, it is in the range of 1 g to 50 g, preferably 2 g to 35 g, more preferably 3 g to 25 g per square meter of the total area of the light-sensitive element and the dye fixing element.

A part, normally 20% or less, of the water may be incorporated in the material.

Examples of solvents to be used in the acceleration of development and/or transfer of a diffusible dye to the dye fixing layer include water, and a basic aqueous solution containing an inorganic alkali metal salt or organic base (these bases include those described with reference to the image formation accelerator). Further, a low boiling solvent, and a mixture of a low boiling solvent and water or a basic aqueous solution may be used. Moreover, a surface active agent, a fog inhibitor, a difficultly soluble metal salt, a complexing compound, etc. may be contained in these solvents.

These solvents may be provided to either or both of the dye fixing material and the light-sensitive material. The amount of these solvents to be used may be not more than the weight thereof corresponding to the maximum swellable volume of the coated film (particularly the weight thereof corresponding to the maximum swellable volume of the coated film, with the weight of the coated film being substracted therefrom).

In order to provide these solvents to the light-sensitive layer or dye fixing layer, a method as disclosed in JP-A-61-147244, page 26, can be used. Alternatively, these solvents may be previously incorporated in either or both of the light-sensitive material and the dye fixing material in the form of microcapsules.

In order to accelerate the migration of a dye, a hydrophilic heat solvent which stays solid at normal temperature but becomes soluble at an elevated temperature may be incorporated in the light-sensitive material or dye fixing material. Such a hydrophilic heat solvent may be incorporated in either or both of the light-sensitive material and the dye fixing material. The layer in which the hydrophilic heat solvent is incorporated may be any of emulsion layer, interlayer, protective layer and dye fixing layer, preferably dye fixing layer and/or its adjacent layers.

Examples of such a hydrophilic heat solvent include ureas, pyridines, amides, sulfonamides, imides, alcohols, oximes, and other heterocyclic groups.

In order to accelerate the migrattion of a dye, a high boiling organic solvent may be incorporated in the light sensitive material and/or dye fixing material.

Examples of the heating means at the development and/or transfer process include a method which comprises bringing the material into contact with a heated block or plate, a hot plate, a hot presser, a heat roller, a halogen lamp heater, an infrared lamp heater, a far infrared lamp heater, etc., and a method which comprises passing the material through a high temperature atmosphere. Alternatively, the light-sensitive material or dye fixing material may be provided with a resistance heating element that is electrified to heat the material. As the heating material layer there can be used one described in JP-A-61 145544.

As pressure conditions and pressure application methods by which the light-sensitive material and the dye fixing material are laminated and adhered to each other there can be used those described in JP-A-61-147244, page 27.

The processing of the photographic elements of the present invention can be accomplished by means of any of various heat development apparatus. For example, apparatus as described in JP-A-59-75247, JP-A-59-177547, JP-A-59-181353, JP-A-60-18951, and JP-A-U-59 25944 may be preferably used (the term "JP-A-U" as used herein means an "unexamined published Japanese utility model application").

The present invention will be further described in the following examples, but the present invention should not be construed as being limited thereto.

EXAMPLE 1

A light-sensitive element was prepared from the components as set forth in Table 1 as light-sensitive element 101.

Light-sensitive silver halide emulsion (for red-sensitive emulsion layer)

Solution (I) and Solution (II) set forth in Table A were simultaneously added dropwise to an aqueous solution of gelatin (obtained by adding 20 g of gelatin, 0.3 g of potassium bromide, 6 g of sodium chloride and 30 mg of the following chemical A to 800 cc of water and heating the mixture to a temperature of 50° C.) which had been thoroughly stirred at the same flow rate in 30 minutes. Solutions (III) and (IV) mentioned below were then simultaneously added to the system in 30 minutes. Three minutes after the beginning of the addition of Solutions (III) and (IV), a mixture of 67 mg of the following sensitizing dye (a) and 133 mg of the following sensitizing dye (b) was added to the system.

After the emulsion was rinsed and desalted, 22 g of lime-treated osein gelatin was added to the emulsion to adjust the pH and pAg values to 6.2 and 7.7, respectively. The emulsion was then subjected to optimum chemical sensitization with sodium thiosulfate, 4-hydroxy-6-methyl-1,3,3a,7-tetrazaindene and chloroauric acid at a temperature of 60° C. Thus, a monodisperse emulsion of cubic silver bromochloride grains having an average grain size of 0.38 μm was obtained. The yield was 635 g.

TABLE A

| | Solution (I) | Solution (II) | Solution (III) | Solution (IV) |
|---|---|---|---|---|
| $AgNO_3$ | 50.0 g | — | 50.0 g | — |
| KBr | — | 28.0 g | — | 35.0 g |
| NaCl | — | 3.4 g | — | — |
| Water to make | 200 cc | 200 cc | 200 cc | 200 cc |

Chemical A

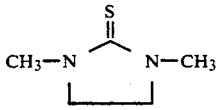

Sensitizing dye (a)

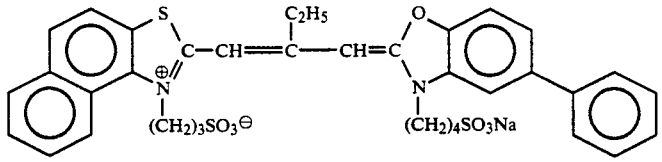

Sensitizing dye (b)

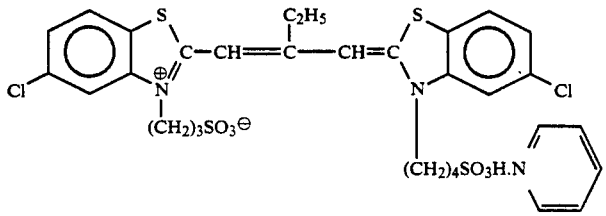

Light-sensitive silver halide emulsion (for green-sensitive emulsion layer)

Solution (I) and Solution (II) set forth in Table B were simultaneously added dropwise to an aqueous solution of gelatin (obtained by adding 20 g of gelatin, 0.3 g of potassium bromide, 6 g of sodium chloride and 15 mg of the chemical A to 730 cc of water and heating the mixture to a temperature of 60° C.) which had been thoroughly stirred in 30 minutes. Solutions (III) and (IV) mentioned below were then simultaneously added to the system in 30 minutes. One minute after completion of the addition of Solutions (III) and (IV), 230 mg of the following sensitizing dye (c) was added to the system.

After the emulsion was rinsed and desalted, 20 g of gelatin was added to the emulsion to adjust the pH and pAg values to proper values. The emulsion was then subjected to optimum chemical sensitization with triethylthiourea, chloroauric acid, and 4-hydroxy-6-methyl-1,3,3a,7-tetrazaindene.

Thus, a monodisperse emulsion of cubic silver bromochloride grains having an average grain size of 0.4 μm was obtained. The yield was 630 g.

TABLE B

| | Solution (I) | Solution (II) | Solution (III) | Solution (IV) |
|---|---|---|---|---|
| $AgNO_3$ | 50.0 g | — | 50.0 g | — |
| KBr | — | 21.0 g | — | 28.0 g |
| NaCl | — | 6.9 g | — | 3.5 g |
| Water to make | 200 cc | 200 cc | 200 cc | 200 cc |

Sensitizing dye (c)

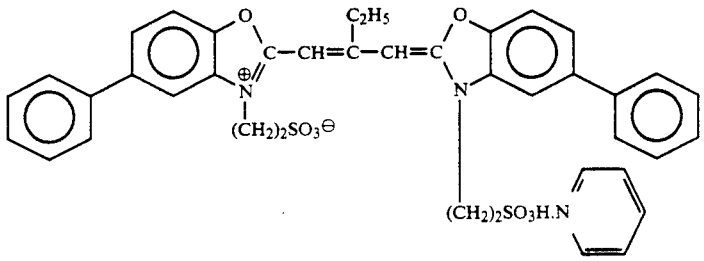

Light-sensitive silver halide emulsion (for blue-sensitive emulsion layer)

Solution (I) and Solution (II) set forth in Table C were simultaneously added to an aqueous solution of gelatin (obtained by adding 20 g of gelatin, 3 g of potassium bromide, 30 mg of the chemical A and 0.25 g of $HO(CH_2)_2S(CH_2)_2S(CH_2)_2OH$ to 800 cc of water and heating the mixture to a temperature of 50° C.) which had been thoroughly stirred in 30 minutes. Solutions (III) and (IV) mentioned below were then simultaneously added to the system in 20 minutes. Five minutes after completion of the addition of Solutions (III) and (IV), a solution of 180 mg of the following sensitizing dye (d) and 60 mg of the following sensitizing dye (e) was added to the system.

After the emulsion was rinsed and desalted, 20 g of lime-treated osein gelatin was added to the emulsion to adjust the pH and pAg values to 6.2 and 8.5, respectively. The emulsion was then subjected to optimum chemical sensitization with sodium thiosulfate, 4-hydroxy-6-methyl-1,3,3A-7-tetrazaindene and chloroauric acid. Thus, 600 g of a monodisperse emulsion of tetradecahedral silver bromochloride grains having an average grain size of 0.40 μm was obtained.

TABLE C

| | Solution (I) | Solution (II) | Solution (III) | Solution (IV) |
|---|---|---|---|---|
| $AgNO_3$ | 30.0 g | — | 70.0 g | — |
| KBr | — | 17.8 g | — | 49.0 g |
| NaCl | — | 1.6 g | — | — |

TABLE C-continued

| Water to make | 180 ml | 180 ml | 350 ml | 350 ml |
|---|---|---|---|---|

Sensitizing dye (d)

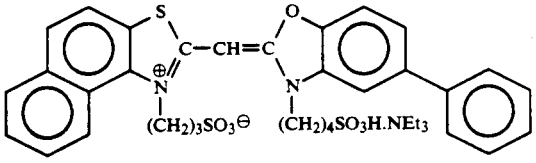

Sensitizing dye (e)

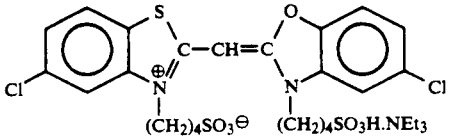

Et: ethyl

The preparation of a zinc hydroxide dispersion will be hereinafter described.

12.5 g of zinc hydroxide having an average grain size of 0.2 μm, 1 g of carboxymethyl cellulose as a dispersant, and 0.1 g of sodium polyacrylate were added to 100 cc of a 4% aqeueous solution of gelatin. The material was then crushed with glass beads having an average grain diameter of 0.75 mm by means of a mill for 30 minutes. The glass beads were then removed to obtain a zinc hydroxide dispersion.

The preparation of an activated carbon dispersion will be hereinafter described.

2.5 g of an activated carbon powder (reagent grade) produced by Wako Pure Chemical Industries, Ltd., 1 g of Demol N produced by Kao Corporation as a dispersant, and 0.25 g of polyethylene glycol nonyl phenyl ether were added to 100 cc of a 5% aqueous solution of gelatin. The material was then crushed with glass beads having an average grain diameter of 0.75 mm by means of a mill for 120 minutes. The glass beads were then removed to obtain a dispersion of activated carbon grains having an average grain diameter of 0.5 μm.

The preparation of an electron transfer agent dispersion will be hereinafter described.

10 g of the following electron transfer agent (*10), 0.5 g of polyethylene glycol nonyl phenyl ether as a dispersant, and 0.5 g of the following anionic surface active agent were added to a 5% aqueous solution of gelatin. The material was then crushed with glass beads having an average grain diameter of 0.75 mm by means of a mill for 60 minutes. The glass beads were then removed to obtain a dispersion of electron transfer agent grains having an average grain diameter of 0.4 μm.

Electron transfer agent (*10)

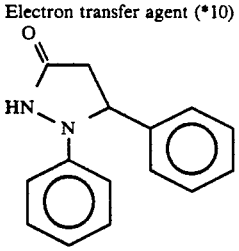

Anionic surface active agent

-continued $$NaO_3S-\underset{}{\overset{CH_2COOCH_2CH(C_2H_5)C_4H_9}{\overset{|}{C}}}HCOOCH_2CH(C_2H_5)C_4H_9$$

The preparation of a gelatin dispersion of a dye providing compound will be hereinafter described.

Components for yellow, magenta and cyan dye providing compounds were measured out in accordance with the formulation set forth in Table D. These components were heated at a temperature of about 60° C. to make uniform solutions. These solutions were each mixed with 100 g of a 10% aqueous solution of lime-treated gelatin, 0.6 g of sodium dodecylbenzenesulfonate and 50 cc of water with stirring. The mixtures were each subjected to dispersion at 10,000 rpm by means of a homogenizer for 10 minutes. These dispersions were gelatin dispersions of yellow, magenta and cyan providing compounds, respectively.

TABLE D

| | Yellow | Magenta | Cyan |
|---|---|---|---|
| Dye providing compound set forth below | (1) | (2) | (3) |
| | 13.0 g | 15.5 g | 16.6 g |
| Electron donor (*1) set forth below | 10.2 g | 8.6 g | 8.1 g |
| High boiling solvent (*2) set forth below | 6.5 g | 7.8 g | 8.3 g |
| Electron transfer agent precursor (*3) set forth below | 0.4 g | 0.7 g | 0.7 g |
| $CO_2C_{12}H_{25}$ \| $CO_2C_{12}H_{25}$ | 3.9 g | — | — |
| Ethyl acetate | 50 cc | 50 cc | 50 cc |

(1) Yellow dye providing compound

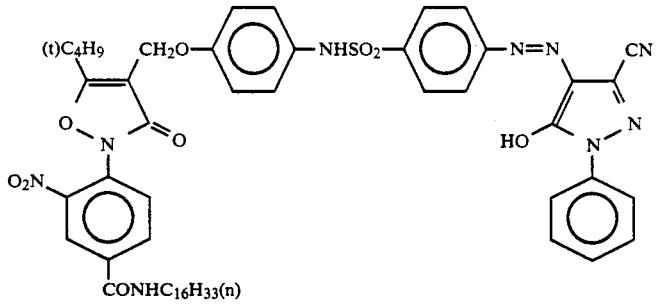

(2) Magenta dye providing compound

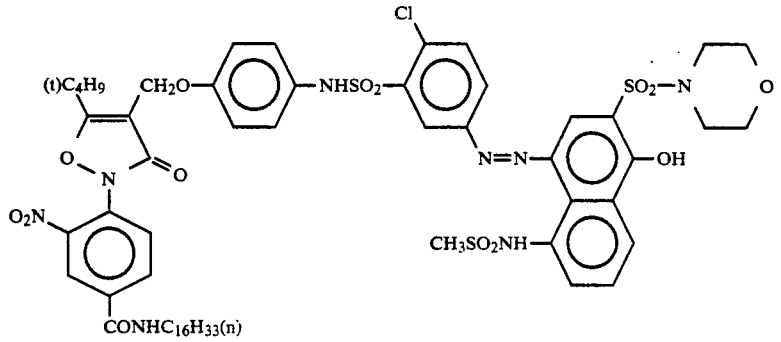

(3) Cyan dye providing compound

TABLE D-continued

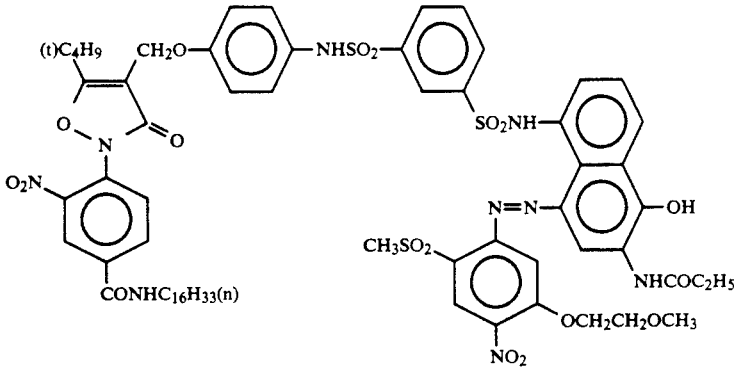

Electron donor (*1)

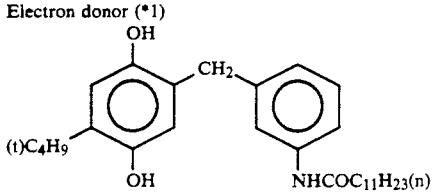

High boiling solvent (*2)

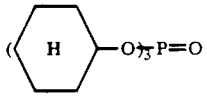

Electron transfer agent precursor (*3)

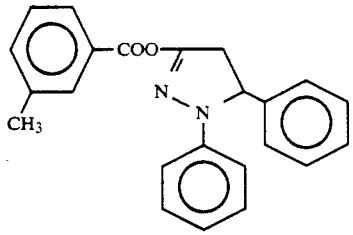

The preparation of a gelatin dispersion of an electron donor (*4) for interlayer will be hereinafter described.

23.6 g of the following electron donor (*4) and 8.5 g of the above mentioned high boiling solvent (*2) were added to 30 cc of ethyl acetate. The mixture was then dissolved at a temperature of 60° C. to make a uniform solution. This solution was mixed with 100 g of a 10% aqueous solution of lime-treated gelatin, 0.25 g of hydrogen sulfite, 0.3 g of sodium dodecylbenzenesulfonate and 30 cc of water with stirring. The mixture was then subjected to dispersion at 10,000 rpm for 10 minutes by means of a homogenizer. This dispersion was a gelatin dispersion of an electron donor (*4).

Electron donor (4*)

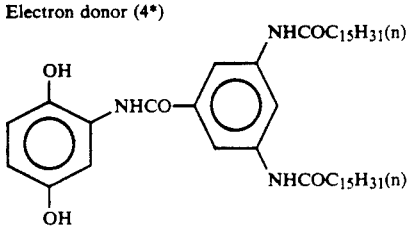

TABLE 1

Constitution of light-sensitive element 101

| Layer No. | Layer name | Formulation | Coated amount (mg/m²) |
|---|---|---|---|
| 6th layer | Protective layer | Gelatin | 900 |
| | | Silica (size: 4 μm) | 40 |
| | | Zinc hydroxide | 900 |
| | | Surface active agent (*5) | 130 |
| | | Surface active agent (*6) | 26 |
| | | Polyvinyl alcohol | 63 |
| | | Lactose | 155 |
| | | Water-soluble polymer (*13) | 8 |
| 5th layer | Blue-sensitive emulsion layer | Blue-sensitive silver halide emulsion | 380 in terms of silver |
| | | Fog inhibitor (*7) | 0.9 |
| | | Gelatin | 560 |
| | | Yellow dye providing compound (1) | 400 |
| | | Electron donor (*1) | 320 |
| | | Electron transfer agent precursor (*3) | 25 |
| | | High boiling solvent (*2) | 200 |
| | | Surface active agent (*8) | 45 |

TABLE 1-continued

| | | | |
|---|---|---|---|
| | | Water-soluble polymer (*13) | 13 |
| 4th layer | Interlayer | Gelatin | 555 |
| | | Electron donor (*4) | 130 |
| | | High boiling solvent (*2) | 48 |
| | | Electron transfer agent (*10) | 85 |
| | | Surface active agent (*6) | 15 |
| | | Surface active agent (*8) | 4 |
| | | Surface active agent (*9) | 30 |
| | | Polyvinyl alcohol | 30 |
| | | Lactose | 155 |
| | | Water-soluble polymer (*13) | 19 |
| | | Film hardener (*11) | 37 |
| 3rd layer | Green-sensitive emulsion layer | Green-sensitive silver halide emulsion | 220 in terms of silver |
| | | Fog inhibitor (*12) | 0.7 |
| | | Gelatin | 370 |
| | | Magenta dye providing compound (2) | 350 |
| | | Electron donor (*1) | 195 |
| | | Electron transfer agent precursor (*3) | 33 |
| | | High boiling solvent (*2) | 175 |
| | | Surface active agent (*8) | 47 |
| | | Water-soluble polymer (*13) | 11 |
| 2nd layer | Interlayer | Gelatin | 650 |
| | | Zinc hydroxide | 300 |
| | | Electron donor (*4) | 130 |
| | | High boiling solvent (*2) | 50 |
| | | Surface active agent (*6) | 11 |
| | | Surface active agent (*8) | 4 |
| | | Surface active agent (*9) | 50 |
| | | Polyvinyl alcohol | 50 |
| | | Lactose | 155 |
| | | Water-soluble polymer (*13) | 12 |
| | | Activated carbon | 25 |
| 1st layer | Red-sensitive emulsion | Red-sensitive silver halide emulsion layer | 230 in terms of silver |
| | | Fog inhibitor (*12) | 0.7 |
| | | Gelatin | 330 |
| | | Cyan dye providing compound (3) | 340 |
| | | Electron donor (*1) | 133 |
| | | Electron transfer agent precursor (*3) | 30 |
| | | High boiling solvent (*2) | 170 |
| | | Surface active agent (*8) | 40 |
| | | Water-soluble polymer (*13) | 5 |
| Support | 96-μm thick polyethylene terephthalate (carbon black layer coated on back side) | | |

Surface active agent (*5)

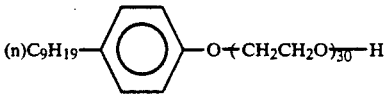

Surface active agent (*6)

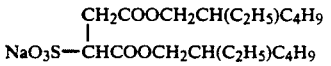

TABLE 1-continued

Water-soluble polymer (*13)

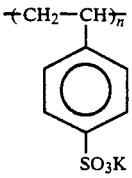

Fog inhibitor (*7)

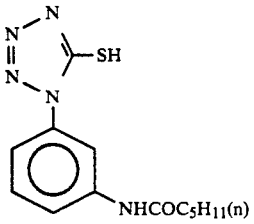

Surface active agent (*8)

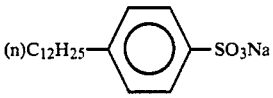

Surface active agent (*9)

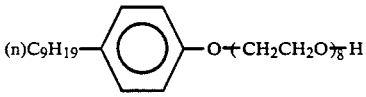

Film hardener (*11)
1,2-Bis(vinylsulfonylacetamido)ethane
Fog inhibitor (*12)

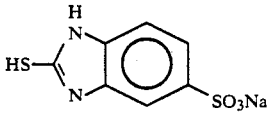

The preparation of a dye fixing element will be hereinafter described.

As set forth in Table E, onto a paper laminated with polyethylene on both sides thereof were coated the 1st to 3rd layers to prepare a dye fixing element 101.

TABLE E

Constitution of dye fixing element 101

| Layer No. | Additive | Added amount ($g/m^2$) |
|---|---|---|
| 3rd layer | Water-soluble polymer (1) | 0.20 |
| | Silicone oil (1) | 0.04 |
| | Surface active agent (1) | 0.001 |
| | Surface active agent (2) | 0.02 |
| | Surface active agent (3) | 0.10 |
| | Guanidium picolate | 0.45 |
| | κ-Carrageenan | 0.06 |
| 2nd layer | Mordant (1) | 2.35 |
| | Water-soluble polymer (1) | 0.20 |
| | Gelatin | 1.40 |
| | Water-soluble polymer (2) | 0.60 |
| | High boiling solvent (1) | 1.40 |
| | Guanidium picolate | 2.25 |
| | Fluorescent brightening agent (1) | 0.05 |
| | Surface active agent (5) | 0.15 |
| 1st layer | Gelatin | 0.45 |
| | Surface active agent (3) | 0.01 |

TABLE E-continued

| | | |
|---|---|---|
| | Water-soluble polymer (1) | 0.04 |
| | Film hardener (1) | 0.30 |
| Paper support laminated with polyethylene on both sides | | |
| Back 1st layer | Gelatin | 3.50 |
| | Film hardener (1) | 0.25 |
| Back 2nd layer | Gelatin | 0.20 |
| | Silicone oil (1) | 0.04 |
| | Surface active agent (4) | 0.01 |
| | Surface active agent (5) | 0.01 |
| | Matting agent (1) | 0.03 |

Silicone oil (1)

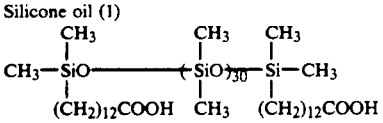

Surface active agent (1)

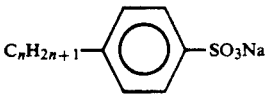

Surface active agent (2)

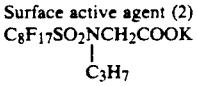

Surface active agent (3)

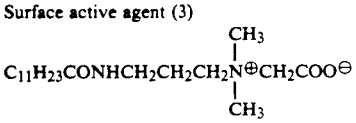

Surface active agent (4)

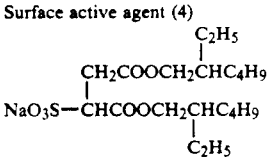

Surface active agent (5)

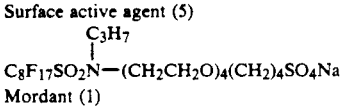

Mordant (1)

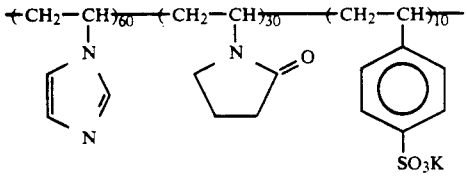

High boiling solvent (1)

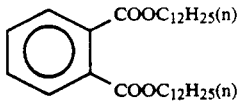

Film hardener (1)

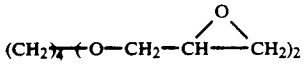

Fluorescent brightening agent (1)
2,4-Bis(5-tertiary-butylbenzoxazolyl(2))thiophene
Water-soluble polymer (1)
Sumikagel L-5-H (produced by Sumitomo Chemical Company, Limited)
Water-soluble polymer (2)
Dextran (molecular weight: 70,000)
Matting agent (1)
Benzoguanamine resin (average grain diameter: 15 μm)

A dye fixing element 102 was prepared in the same manner as the preparation for the dye fixing element 101 except that the back layer was omitted and that the formulation of the 2nd layer (mordant layer) was as follows:

| (2nd layer of dye fixing element 102) | (g/m²) |
|---|---|
| Gelatin | 0.8 |
| Water-soluble polymer (2) | 0.6 |
| Nipol LX814 (solid) | 2.0 |
| Mordant (1) | 2.40 |
| Guanidium picolate | 2.20 |
| Fluorescent brightening agent (1) | 0.055 |
| Stain inhibitor (1) | 0.06 |
| High boiling solvent (1) | 1.40 |
| Surface active agent (4) | 0.025 |

Stain inhibitor (1)

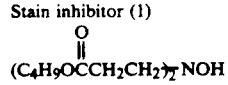

Dye fixing elements 103 to 110 were prepared in the same manner as the preparations for the dye fixing elements 101 and 102 except that the formulation of the 3rd layer was altered as set below.

Dye fixing elements 103 and 104

Dye fixing elements 103 and 104 were prepared in the same manner as the preparations for the dye fixing elements 101 and 102 except that the formulation of the 3rd layer was altered as follows:

| | (g/m²) |
|---|---|
| Water-soluble polymer (1) | 0.09 |
| Surface active agent (1) | 0.001 |
| Surface active agent (2) | 0.01 |
| Surface active agent (3) | 0.01 |
| Guanidium picolate | 0.45 |
| κ-Carrageenan | 0.03 |
| Asahi Guard AG530 | 0.12 |

Dye fixing elements 105 to 107

Dye fixing elements 105 to 107 were prepared in the same manner as the preparation for the dye fixing element 102 except that the formulation of the 3rd layer was altered as follows:

| | (g/m²) |
|---|---|
| Water-soluble polymer (1) | x |
| Surface active agent (1) | 0.001 |
| Surface active agent (2) | 0.01 |
| Surface active agent (3) | 0.01 |
| Guanidium picolate | 0.45 |
| κ-Carrageenan | y |
| Asahi Guard AG530 | 0.12 |

In the above formulation, x and y for the dye fixing elements 105, 106 and 107 are (0.27 and 0.09), (0.18, 0.06), and (0.03, 0.03), respectively.

Dye fixing element 108

A dye fixing element 108 was prepared in the same manner as the prearation for the dye fixing element 102 except that the formulation of the 3rd layer was altered as follows:

| | (g/m²) |
|---|---|
| Water-soluble polymer (1) | 0.09 |
| Surface active agent (1) | 0.01 |
| Surface active agent (2) | 0.02 |
| Surface active agent (3) | 0.10 |
| κ-Carrageenan | 0.03 |
| Asahi Guard AG530 | 0.12 |

-continued

| | (g/m²) |
|---|---|
| Guanidium picolate | 0.45 |

Dye fixing elements 109 to 111

Dye fixing elements 109 to 111 were prepared in the same manner as the preparation for the dye fixing element 103 except that Asahi Guard AG530 was replaced by Compound (3) of the present invention and the following fluorine compounds (a) and (b), respectively.

Fluorine compound (a) $C_8F_{17}SO_3N(C_2H_5)_4$ (b) $CF_3(CF_2)_7—C_6H_4—O—(CH_2CH_2O)_{10}H$ These light-sensitive elements and dye fixing elements were each processed by means of an image recording apparatus as disclosed in JP-A-2-84634. Specifically, these light-sensitive elements were each subjected to scanning exposure to an original image (test chart on which yellow, magenta, cyan and gray wedges having a continuous density gradation had been recorded) through a slit, dipped in water kept at a temperature of 35° C. for about 5 seconds, squeezed by rollers, and then immediately laminated with the corresponding dye fixing element in such an arrangement that the film surfaces were brought into contact with each other. The laminate was heated for 15 seconds by a heat roller which had been adjusted so as to heat the surface of the wet film to a temperature of 80° C. When the light-sensitive element was then peeled off from the dye fixing material, a sharp color image corresponding to the original image was formed on the dye fixing element.

These dye fixing elements were then measured for maximum transfer density Dmax by means of a Macbeth reflection densitometer. The results are set forth in Table F.

The contact angle of the surface of the dye fixing element to a drop of methane iodide before the processing was measured at 25° C. The results are set forth in Table F.

The contact dye transfer of these dye fixing elements was evaluated as follows:

Fully white and black dye fixing elements were prepared by the development of unexposed light-sensitive elements and light-sensitive elements which had been fully exposed to white light combined with dye fixing elements prepared according to the present invention. These dye fixing elements were each moisture-conditioned at a temperature of 25° C. and 80% RH for 1 hour. The fully black dye fixing element and the fully white dye fixing element were then laminated with each other in a face-to-face arrangement. The laminate was then stored under a load of 500 g/20 cm² at a temperature of 25° C. and 80% RH for 3 days. The two dye fixing elements were peeled off from each other. The degree of retransfer of a dye from the fully black dye fixing element to the fully white dye fixing element was evaluated according to the following criteria:

A: Little or no dye transfer

B: Slight dye transfer

C: Much dye transfer

The results are set forth in Table F.

TABLE F

| Dye fixing element | Dmax Cyan | Dmax Magenta | Dmax Yellow | Contact angle | Contact dye transfer |
|---|---|---|---|---|---|
| 101 (comparison) | 2.20 | 2.18 | 2.08 | 64.4° | B |
| 102 (comparison) | 2.16 | 2.10 | 2.00 | 66.8° | B-C |
| 103 (present invention) | 2.14 | 2.08 | 1.98 | 90.5° | A |
| 104 (present invention) | 2.13 | 2.06 | 1.95 | 92.3° | A |
| 105 (present invention) | 2.15 | 2.06 | 1.98 | 84.8° | A-B |
| 106 (present invention) | 2.12 | 2.05 | 1.96 | 92.9° | A-B |
| 107 (present invention) | 2.14 | 2.07 | 1.95 | 92.9° | A |
| 108 (present invention) | 2.18 | 2.13 | 2.02 | 90.0° | A |
| 109 (present invention) | 2.14 | 2.11 | 1.97 | 88.0° | A |
| 110 (comparison) | 2.15 | 2.07 | 1.98 | 60.4° | B |
| 111 (comparison) | 2.12 | 2.10 | 1.97 | 72.0° | B |

Table F shows that the contact dye transfer can be remarkably eliminated with little or no deterioration of Dmax by using the fluorine compounds of the present invention to adjust the contact angle of the surface of the processed dye fixing element to a drop of methane iodide to 80° or more.

EXAMPLE 2

A light-sensitive element 201 was prepared in the same manner as the preparation for the light-sensitive element 101 of Example 1.

The preparation of a dye fixing element will be hereinafter described.

As set forth in Table G, onto a 100-μm thick PET (polyethylene terephthalate) were coated the 1st to 3rd layers to prepare a dye fixing element 201.

TABLE G

| Constitution of dye fixing element 201 | | |
|---|---|---|
| Layer No. | Additive | Added amount (g/m²) |
| 3rd layer | Water-soluble polymer (1) | 0.20 |
| | Silicone oil (1) | 0.04 |
| | Surface active agent (1) | 0.001 |
| | Surface active agent (2) | 0.02 |
| | Surface active agent (3) | 0.10 |
| | Guanidium picolate | 0.45 |
| | κ-Carrageenan | 0.06 |
| 2nd layer | Mordant (1) | 2.35 |
| | Water-soluble polymer (1) | 0.20 |
| | Gelatin | 1.40 |
| | Water-soluble polymer (2) | 0.60 |
| | High boiling solvent (1) | 1.40 |
| | Guanidium picolate | 2.25 |
| | Fluorescent brightening agent (1) | 0.05 |
| | Surface active agent (5) | 0.15 |
| 1st layer | Gelatin | 0.45 |
| | Surface active agent (3) | 0.01 |
| | Water-soluble polymer (1) | 0.04 |
| | Film hardener (1) | 0.30 |
| Support (100-μm thick PET) | | |
| Back 1st layer | Gelatin | 3.50 |
| | Film hardener (1) | 0.25 |
| Back 2nd layer | Gelatin | 0.20 |
| | Silicone oil (1) | 0.04 |
| | Surface active agent (4) | 0.01 |
| | Surface active agent (5) | 0.01 |
| | Matting agent (1) | 0.03 |

Dye fixing elements 202, 203, 204 and 205 were prepared in the same manner as the preparation for the dye fixing element 201 except that Asahi Guard AG530, Compound (3) of the present invention, and 0.2 g/cm$^2$ of the following fluorine compounds (a) and (b) were incorporated in the back 2nd layer, respectively.

Fluorine compound (a) $C_8F_{17}SO_3N(C_2H_5)_4$ (b): $CF_3(CF_2)_7—C_6H_4—O—(CH_2CH_2O)_{10}H$ Dye fixing elements 206 to 210 were prepared in the same manner as the preparations for the dye fixing elements 201 to 205 except that gelatin to be incorporated in the back 2nd layer was replaced by a polyvinyl alcohol (polymerization degree: 2,000; fully saponified product).

A dye fixing element 211 was prepared in the same manner as the preparation for the dye fixing element 201 except that no back layer was provided. A dye fixing element 212 was prepared in the same manner as the preparation for the dye fixing element 202 except that gelatin and the film hardener (1) to be incorporated in the back 1st and 2nd layers were omitted. Further, a dye fixing element 213 was prepared in the same manner as the preparation for the dye fixing element 202 except that guanidium picolate to be incorporated in the 2nd and 3rd layers in Table G were omitted.

These dye fixing elements 201 to 213 were prepared in A-4 size. These dye fixing elements were each moisture-conditioned at a temperature of 25° C. and 80% RH for 4 hours. These dye fixing elements were then laminated with each other in a back-to-face arrangement. The laminate was then stored under a load of 3 kg at a temperature of 35° C. and 80% RH for 1 week. The dye fixing element which had faced the back side of the other dye fixing element was then combined with the light-sensitive element 201. The laminate was then processed in the same manner as in Example 1. When the light-sensitive element was then peeled off from the dye fixing element, a color image corresponding to the original image was formed on the dye fixing elements 201 to 212. No color image was formed on the dye fixing element 213.

The uniformity of the color image formed on the dye fixing elements 201 to 212 was evaluated according to the following criteria:

A: Uniform image obtained without "blank areas"

B: Slight "blank areas" on the top portion

C: Extremely light "blank areas" on the entire surface

D: "Blank areas" on the entire surface

The dye fixing elements 201 to 212 which had not been processed were measured for haze and contact angle of the back surface thereof to a drop of methane iodide (25° C.).

The de fixing elements 201 to 212 which had been processed were moisture-conditioned at a temperature of 25° C. and 20% RH for 2 hours, and then measured for curling. With the dye fixing element put on a desk with its surface facing upward, the curling degree is represented by the average value of the height from the desk at the four corners thereof.

The results are set forth in Table H.

TABLE H

| Dye fixing element | Contact angle | Haze (%) | "Blank areas" | Curling degree |
|---|---|---|---|---|
| 201 (comparison) | 67° | 12 | B-C | 1 mm |
| 202 (present invention) | 88° | 15 | A-B | 1 mm |
| 203 (present invention) | 84° | 15 | A-B | 1 mm |
| 204 (comparison) | 73° | 13 | B | 0 mm |
| 205 (comparison) | 68° | 12 | B-C | 1 mm |
| 206 (comparison) | 65° | 13 | B-C | 2 mm |
| 207 (present invention) | 92° | 16 | A | 1 mm |
| 208 (present invention) | 98° | 16 | A | 1 mm |
| 209 (comparison) | 70° | 15 | B | 1 mm |
| 210 (comparison) | 69° | 17 | B | 1 mm |
| 211 (comparison) | | 7 | A | 25 mm |
| 212 (comparison) | | 25 | A | 23 mm |

Table H shows that the dye fixing elements of the present invention show little or no "blank areas" without causing any drop in transparency even after stored in laminated form under the circumstances of high humidity.

It is further shown that the specimens comprising no hydrophilic binder (e.g., gelatin) coated on the back surface disadvantageously show an extremely large curling under the circumstances of low humidity.

In accordance with the present invention, a dye fixing element can be provided which can provide a sufficient image density without inhibiting transfer during the image formation in an image receiving material which has undergone development or heat development/-transfer and doesn't suffer from "contact dye transfer" or generation of "blank areas" even after prolonged storage under the circumstances of high humidity.

While the invention has been described in detail and with reference to specific embodiments thereof, it will be apparent to one skilled in the art that various changes and modifications can be made therein without departing from the spirit and scope thereof.

What is claimed is:

1. A dye fixing element comprising a dye fixing layer on which a diffusive dye produced or released by developing a light-sensitive element containing at least a light-sensitive silver halide, a hydrophilic binder and a dye providing compound which produces or releases a diffusive dye in correspondence to or counter correspondence to the exposure in the presence of a base and/or base precursor after or simultaneously with imagewise exposure is transferred and fixed, wherein the outermost layer on the dye fixing layer side or on the back layer side opposite thereto contains at least one compound represented by the following general formula (I) and exhibits a contact angle of 80° or more to a drop of methane iodide $$(RfCH_2O)_n—PO(OM)_m \quad (I)$$

wherein n and m are each 1 or 2 and n and m satisfy the equation: $n+m=3$; Rf represents a perfluoroalkyl group; and M represents an alkali metal ion, $NH^{4+}$ or secondary, tertiary or quaternary ammonium ion.

2. A dye fixing element as claimed in claim 1, wherein said base and/or base precursor is partially or entirely incorporated in the layers constituting said dye fixing element.

3. A dye fixing element as claimed in claim 1, wherein said contact angle is 85° or more.

4. A dye fixing element as claimed in claim 1, wherein said compound represented by the general formula (I) is contained in an amount of 5 to 100% by weight of the total coated amount of said outermost layer as calculated in terms of dry film.

5. A dye fixing element as claimed in claim 1, wherein development is heat development.

6. A dye fixing element as claimed in claim 5, wherein heat development and transfer are effected in the presence of a small amount of water.

7. A dye fixing element as claimed in claim 1, wherein the perfluoroalkyl group represented by Rf contains at least 8 carbon atoms.

8. A dye fixing element as claimed in claim 1, wherein the perfluoroalkyl group represented by Rf has 8 to 12 carbon atoms.

* * * * *